United States Patent [19]

Dougherty

[11] 4,383,618

[45] May 17, 1983

[54] CHILDPROOF CONTAINER

[75] Inventor: Thomas R. Dougherty, Mays Landing, N.J.

[73] Assignee: Dougherty Brothers Company, Buena, N.J.

[21] Appl. No.: 348,545

[22] Filed: Feb. 12, 1982

[51] Int. Cl.[3] ..... B65D 55/02

[52] U.S. Cl. ..... 215/216

[58] Field of Search ..... 215/216, 217, 218, 219, 215/221, 330

[56] References Cited

U.S. PATENT DOCUMENTS 3,768,681 10/1973 Dougherty, Sr. .
3,881,624 5/1975 Dougherty, Sr. .
3,993,209 11/1976 Julian ..... 215/216
4,134,513 1/1979 Mumford ..... 215/216
4,138,028 2/1979 Price et al. ..... 215/216
4,213,534 7/1980 Montgomery ..... 215/216

*Primary Examiner*—George T. Hall
*Attorney, Agent, or Firm*—Seidel, Gonda, Goldhammer & Panitch

[57] ABSTRACT

A glass container has an opening closed by a quick-release plastic cap. Each of the cap and bottle have double pitch threads in mating engagement. Lugs on the cap are in contact with lugs on the bottle which interfere with unthreading the cap. A lower end portion of the cap is deformable radially inwardly for causing the cap lugs to disengage from the bottle lugs whereby the cap may be unthreaded.

4 Claims, 8 Drawing Figures

FIG. 1
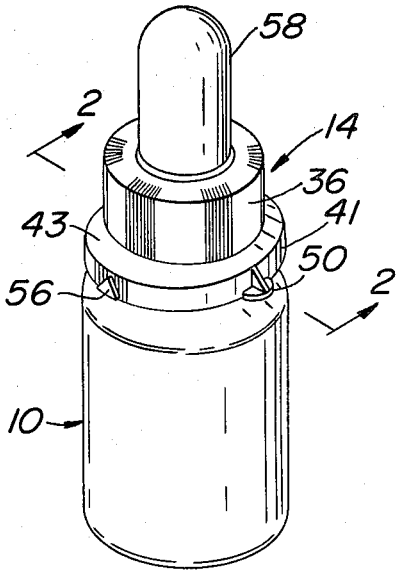
FIG. 2
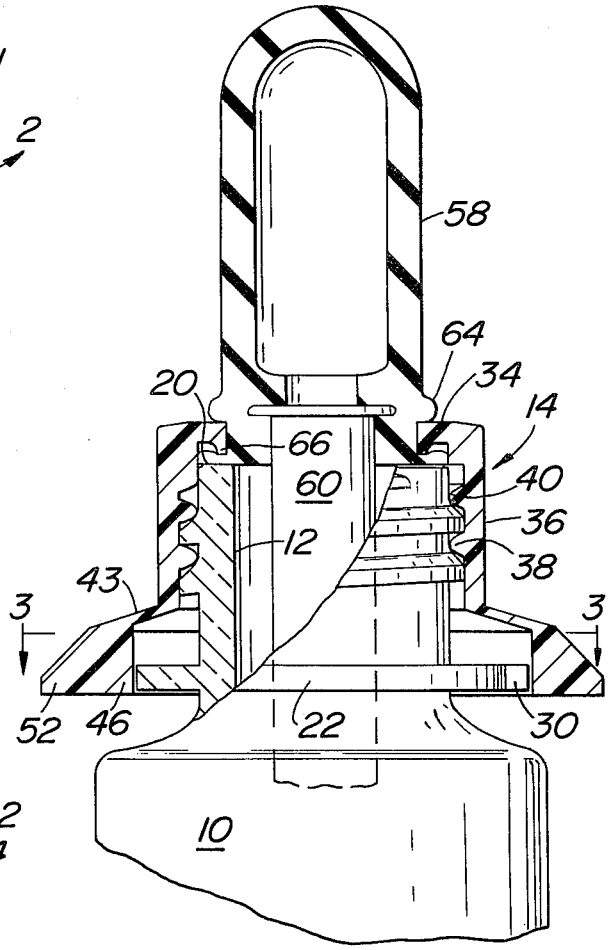
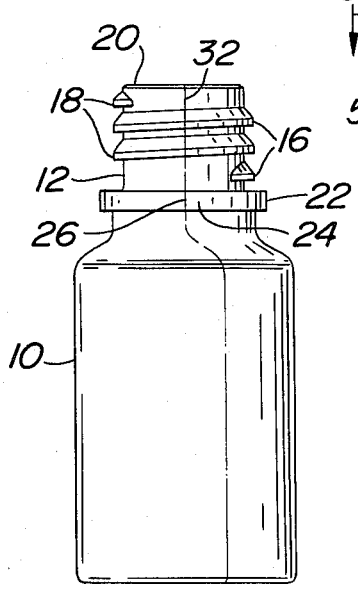
FIG. 8

FIG. 3
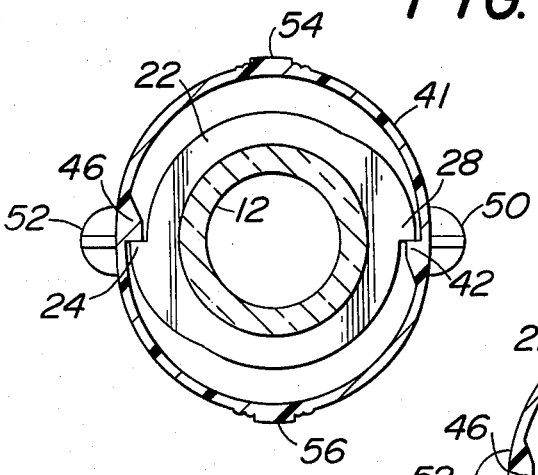
FIG. 4
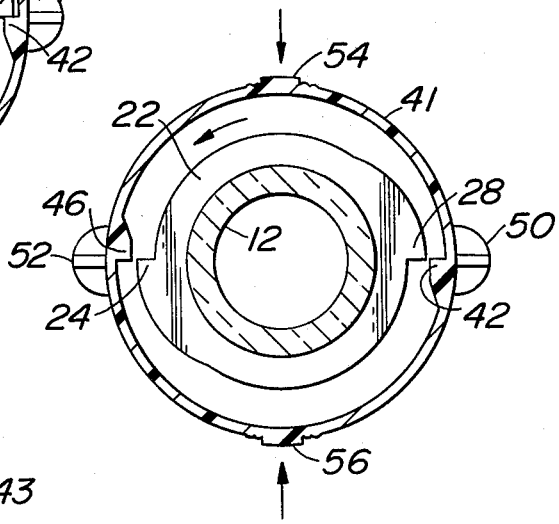
FIG. 5
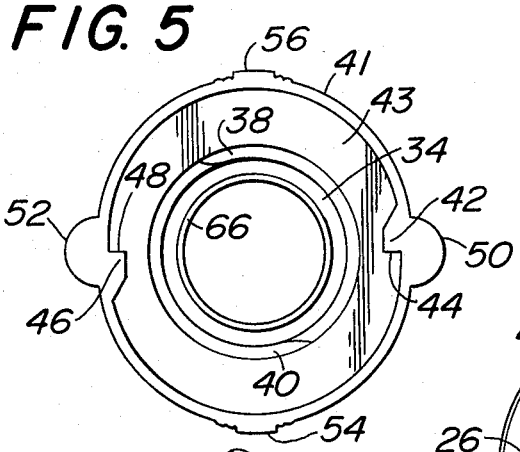
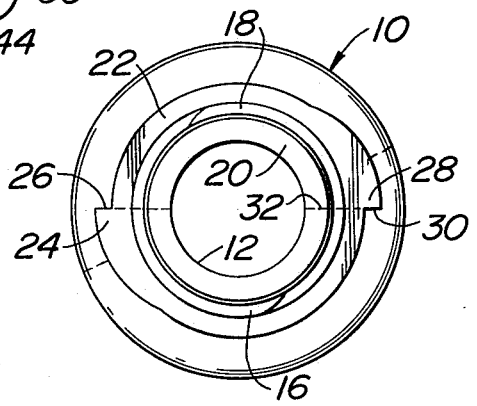
FIG. 6
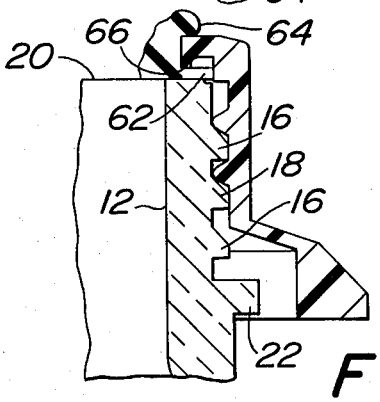
FIG. 7

CHILDPROOF CONTAINER

BACKGROUND

This invention is directed to a container with a safety cap to prevent children from having access to products in the container which may cause harm to the children or are of such a nature that it is desired that children not have ready access thereto. The products within the container may be any one of a wide variety of solid or liquid products including medicines, detergents, caustic products, etc.

The container of the present invention is preferably of the general type disclosed in U.S. Pat. Nos. 3,768,681 granted on Oct. 30, 1973 to Frank E. Dougherty Sr. and entitled Container With Safety Cap and 3,881,624 granted on May 6, 1975 to Frank E. Dougherty Sr. and entitled Tamper Proof Container. As stated in the last mentioned patent, the cap is preferably made from material which is at least as hard as the material of the container.

There are occasions when it is desired to make the container from glass and the cap from a polymeric plastic material. Glass is substantially harder than a polymeric plastic material such as polypropylene. Hence, application of force to the cap in an effort to unthread the cap will readily deform the lugs on the cap. When this occurs, the container is no longer childproof. The present invention is directed to a solution of this problem.

SUMMARY OF THE INVENTION

The apparatus of the invention includes a container having an opening at one end and closed by a quick-release plastic cap. Each of the cap and bottle have double pitch threads in mating engagement. A radial flange is provided on the bottle below the elevation of the bottle threads. A pair of lugs are provided on the outer periphery of the flange. The lugs have diametrically opposite radially disposed side faces. A pair of lugs are provided on the inner surface of the lower end portion of the cap. Each cap lug mates with a lug on the container. The lower end portion of the cap is deformable radially inwardly for causing the cap lugs to disengage from the bottle lugs.

It is an object of the present inventoin to provide a childproof container which solves the problem when the container is made from material substantially harder than the material of the cap.

It is another object of the present invention to provide a childproof container having a cap which may be quickly released by rotation through an arc of approximately 180°.

It is another object of the present invention to provide a childproof container made from glass and having diametrically opposite lugs each having a radially disposed side face.

Other objects and advantages will appear hereinafter.

For the purpose of illustrating the invention, there is shown in the drawing a form which is presently preferred; it being understood, however, that this invention is not limited to the precise arrangements and instrumentalities shown.

FIG. 1 is a perspective view of a container in accordance with the present invention.

FIG. 2 is a sectional view taken along the line 2—2 in FIG. 1 but on an enlarged scale.

FIG. 3 is a sectional view taken along the line 3—3 in FIG. 2 but on a reduced scale.

FIG. 4 is a view similar to FIG. 3 but showing the lugs disengaged due to deformation of the lower end portion of the cap.

FIG. 5 is a bottom plan view of the cap.

FIG. 6 is a top plan view of the container.

FIG. 7 is a sectional detail showing mating threads on the cap and container.

FIG. 8 is an elevation view of the container without the cap.

DETAILED DESCRIPTION

Referring to the drawing in detail, wherein like numerals indicate like elements, there is shown in FIG. 1 a container in accordance the present invention designated generally as 10. The upper end of the container 10 is provided with a neck 12 constituting an inlet and outlet to the container. The opening at the neck 12 is hermatically sealed by means of a cap 14.

On the outer periphery of the neck 12, there is provided two discrete threads 16 and 18. Each of the threads 16, 18 extends around the neck approximately $1\frac{1}{8}$ times (400°). Each of the threads 16, 18 has a double pitch. The thread lead is twice the pitch. The threads 16, 18 facilitate separation of cap 14 in approximately $\frac{1}{2}$ a turn of the cap.

The end face of the container 10 at the opening is designated 20. The threads 16, 18 are between the end face 20 and a radially outwardly directed flange 22. Flange 22 preferably has a thickness equal to its radial length, namely 2.4 mm. At the outer periphery of the flange 22 there is provided a lug 24 having a radially disposed vertical face 26. The lug 24 has a cam surface on its outer periphery. Diametrically opposite lug 24, there is provided another lug 28 having a similar face 30. See FIG. 6. The faces 26 and 30 lie along the mold parting line 32 on the neck of the container 10 and preferably have a radial length of 1.6 mm. See FIG. 8. When the faces 26 and 30 do not lie along the mold parting line on the container 10, they are difficult to mold and generally are rounded whereby they cannot perform their locking function in a reliable manner.

The cap 14 is made from a polymeric plastic such as polypropylene while the container 10 is preferably made from a vitreous material such as glass. Cap 14 has a top wall 34 extending radially inwardly from a cylindrical body portion 36. Portion 36 preferably has sets of vertical grooves on its outer periphery to prevent slippage with a person's finger during rotation. On the inner surface of the portion 36, there is provided a pair of discrete threads 38 and 40. Thread 38 cooperates with thread 18 while thread 40 cooperates with thread 16. The lower end of cylindrical portion 36 is connected to a generally cylindrical lower end portion 41 by way of a tapered wall 43. As shown more clearly in FIG. 5, the portion 41 is generally eliptical.

As shown more clearly in FIG. 5, the portion 41 on its inner peripheral surface is provided with a pair of lugs 42, 46 at the minor diameter thereof. Each lug has a cam surface terminating in a radially disposed vertical face. Lug 42 has a face 44 while lug 46 has a face 48. Face 44 is adapted to cooperate with face 30 on the lug 28. Face 48 is adapted to cooperated with face 26 on the lug 24. See FIG. 3.

The portion 41 on its outer peripheral surface is provided with a projection 50 at the location of lug 42 and with a projection 52 at the location of lug 46. The projections 50, 52 are adapted to induce someone trying to open the container 10 to manipulate the projections. The only effective manipulation obtained by contact with the projections 50, 52 is to inhibit any separation of the mating faces on the respective lugs on th cap and neck. Along the major diameter of portion 41, and 90° with respect to the projections 50, 52, there is provided indicators 54 and 56. When radially inwardly directed pressure is applied to indicators 54 and 56 as shown in FIG. 4, lug 46 disengages itself from lug 24 while lug 42 disengages itself from lug 28.

The top wall 34 on the cap 14 may extend across the entire end face 20 of the neck 12. For purposes of illustration, the wall 34 of cap 14 supports a flexible hollow bulb 58 to which is attached a medicine dropper tube 60. The bulb 58 has a flange 62 at its lower end and a bead 64 spaced therefrom. The area between flange 62 and bead 64 accommodates the top wall 34 on the cap 14. The inner periphery of the wall 34 has a axially directed flange 66. Flange 66 deforms the flange 62 into contact with the end face 20 on the neck 12 to prevent or retard anyone from removing the bulb 58 by pulling on the same.

The present invention is utlized as follows. The cap 14 may be threaded to the neck 12 by relative rotation of approximately 180°. The cam surface on the inner periphery of the lugs 42, 46 contacts the cam surface on the outer periphery of the lugs 24, 28 and deforms the portion 41 outwardly until the mating lugs snap together as shown in FIG. 3. In the absence of the mating lugs, the double pitch threads would not be sufficient to hold the cap 14 on the container 10.

To obtain access to the contents of container 10, pressure is applied radially inwardly at the indicators 54, 56. Such deformation causes the lug 46 to disengage from lug 24 and causes lug 42 to disengage from lug 28 as shown in FIG. 4. Thereafter, cap 14 can be disengaged completely from the neck 12 after relative rotation of approximately 180 . Rapid disengagement is an advantage when pressure must be applied at two locations defined by indicators 54, 56.

The utilization of discrete dual threads with a double pitch facilitates a quick release of the cap 14. Locating the lugs 24 and 28 on the outer periphery of a flange 22 minimizes the mass for the lugs, positions the lugs radially outwardly from the threads 16, 18, and facilitates the ease with which the container 10 can be made from glass. Locating the faces 26 and 30 along the neck parting line 32 during the manufacture of the container 10, facilitates providing planar vertical faces and assures good mating cooperative contact between the lugs on the container and the lugs on the cap. If desired, the faces 26 and 30 may be angled slightly with respect to a radius in a manner so as to cause the lugs 42, 44 to be biased inwardly when the cap is rotated without first pressing on the indicators 54, 56.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus comprising a container having an opening at one end, a plastic cap closing said opening, said cap having threads mating with threads on the container, said container having a pair of lugs, said cap having a mating pair of lugs, said cap having a portion which is deformable to disengage the cap lugs from the bottle lugs, said threads being double pitch threads for quick release of the cap, said container having a radially outwardly extending flange below the elevation of said container threads, said container lugs being on the outer periphery of said flange, each container lug having a vertical side face lying generally along a mold parting line for the container neck.

2. Apparatus in accordance with claim 1 wherein the threads on the container are two discrete double pitch threads, the threads on the container being two discrete double pitch threads.

3. Apparatus in accordance with claim 2 wherein each of said threads has an arcuate length of approximately 400°.

4. Apparatus in accordance with claim 1, 2 or 3 wherein said container is made from a vitreous material with the radial length of said flange being greater than the radial length of the lug faces on said container neck.

* * * * *